US007900851B2

(12) United States Patent
Ruttenberg

(10) Patent No.: US 7,900,851 B2
(45) Date of Patent: Mar. 8, 2011

(54) POP-UP SPRAYING DEVICES WITH A FLEXIBLE STEM

(75) Inventor: Gideon Ruttenberg, Indio, CA (US)

(73) Assignee: Developed Research for Irrigation Products, Inc., Indio, CA (US)

( * ) Notice: Subject to any disclaimer, the term of this patent is extended or adjusted under 35 U.S.C. 154(b) by 262 days.

(21) Appl. No.: 12/220,835

(22) Filed: Jul. 28, 2008

(65) Prior Publication Data

US 2009/0032614 A1 Feb. 5, 2009

Related U.S. Application Data

(60) Provisional application No. 60/962,085, filed on Jul. 27, 2007.

(51) Int. Cl.

| | |
|---|---|
| ***B05B 15/10*** | (2006.01) |
| ***B05B 1/08*** | (2006.01) |
| ***B05B 15/06*** | (2006.01) |
| ***B05B 15/08*** | (2006.01) |

(52) U.S. Cl. ..... 239/205; 239/99; 239/203; 239/204; 239/588

(58) Field of Classification Search ..... 239/99, 239/195, 197, 200–206, 587.1, 588, DIG. 1
See application file for complete search history.

(56) References Cited

U.S. PATENT DOCUMENTS

| | | | | |
|---|---|---|---|---|
| 4,018,386 | A * | 4/1977 | Barichello | 239/200 |
| 4,113,181 | A * | 9/1978 | Sheets | 239/206 |
| 4,474,207 | A | 10/1984 | Rosenberg | |
| 4,781,217 | A | 11/1988 | Rosenberg | |
| 4,892,252 | A * | 1/1990 | Bruninga | 239/205 |
| 4,919,332 | A | 4/1990 | Bailey | |
| 4,938,420 | A | 7/1990 | Ruttenberg | |
| 4,955,539 | A | 9/1990 | Ruttenberg | |
| 5,039,011 | A * | 8/1991 | Parker | 239/1 |
| 5,314,116 | A | 5/1994 | Krauth | |
| 5,507,436 | A | 4/1996 | Ruttenberg | |
| 5,531,381 | A | 7/1996 | Ruttenberg | |
| 5,579,870 | A | 12/1996 | Ruttenberg | |
| 5,727,733 | A | 3/1998 | Ruttenberg | |
| 5,803,365 | A | 9/1998 | Ruttenberg | |
| 5,992,760 | A | 11/1999 | Kearby et al. | |

(Continued)

OTHER PUBLICATIONS

International Search Report and Written Opinion for International Application No. PCT/US 08/09143 dated Oct. 30, 2008.

*Primary Examiner* — Darren W Gorman
(74) *Attorney, Agent, or Firm* — Patterson & Sheridan, L.L.P.

(57) ABSTRACT

Embodiments of the invention provide an irrigation pop-up with a flexible stem which may be a pulsating or conventional (i.e., non-pulsating) irrigation sprayer or sprinkler. The flexible stem enables an extended stem to be bent instead of being severed, as experienced by traditional irrigation systems, if impacted by an outside force. In one embodiment, the flexible stem contains a lower rigid segment and an upper rigid segment, each having a passageway extending from an inlet, through the segment, to an outlet. An elastic hollow member, such as a rubber tube, is coupled to and in fluid communication with the passageways of the lower and upper rigid segments. Therefore, a water flow path extends from the water inlet, through the passageway within the lower rigid segment, through the channel of the elastic hollow member, through the passageway within the upper rigid segment, and out through the nozzle, such as a sprayer or sprinkler.

27 Claims, 13 Drawing Sheets

U.S. PATENT DOCUMENTS

| | | | | |
|---|---|---|---|---|
| 6,155,493 | A | 12/2000 | Kearby et al. | |
| 6,209,801 | B1 | 4/2001 | Kearby et al. | |
| 2001/0028004 | A1 | 10/2001 | Kearby et al. | |
| 2005/0103887 | A1 | 5/2005 | McCormick | |
| 2006/0065306 | A1 | 3/2006 | Mortensen | |
| 2006/0273191 | A1* | 12/2006 | Pastuch | 239/201 |
| 2006/0278727 | A1 | 12/2006 | Kah, Jr. | |
| 2006/0283976 | A1 | 12/2006 | Wlodarczyk | |
| 2007/0095935 | A1 | 5/2007 | Katzman et al. | |
| 2008/0164341 | A1 | 7/2008 | Katzman et al. | |

* cited by examiner

POP-UP SPRAYING DEVICES WITH A FLEXIBLE STEM

CROSS-REFERENCE TO RELATED APPLICATION

This application claims benefit of U.S. Ser. No. 60/962,085, filed Jul. 27, 2007, which is incorporated herein by reference in its entirety.

BACKGROUND OF THE INVENTION

1. Field of the Invention

Embodiments of the invention generally relate to irrigation devices, and more particularly, to pop-up irrigation sprayers and sprinklers.

2. Description of the Related Art

Pop-up and pulsating irrigation pop-up sprayers and sprinklers, used primarily for irrigation of turf, have stems which are rigid and inflexible. These rigid stems are susceptible to breaking from outside forces that may be applied in the field, for example, when someone accidentally steps on or drives over the pop-up sprayer or sprinkler. The breaking of an individual pop-up spraying device can cause many problems, such as a large loss of water that escapes the irrigation system through the body of the broken pop-up spraying device. This large loss of water can causes localized flooding around the broken pop-up spraying device and generally wastes valuable water resources. In some irrigation systems containing the pulsating irrigation pop-up sprayers or sprinklers, the breakage of one pop-up spraying device can cause the remainder of the irrigation system to cease operation because of pressure drop in the water supply system.

In some pop-up spraying devices, at the beginning of each irrigation cycle, water flows into the body of the pop-up spraying device, causing the rigid stem to move up, and at the same time, water also flows through the spraying device, which is connected to the outlet of the stem. Therefore a high flow of water is often used to force each unit to a popped-up position. For this reason, traditional pop-up spraying devices are produced with a large inlet port having a diameter within a range from about 1.0 cm to 1.5 cm at the inlet to the body of the pop-up sprinkler device. Therefore, in an irrigation system with traditional pop-up spraying device, a large amount of water is wasted when the rigid stem breaks.

Therefore, a need exists for an irrigation pop-up sprayer or sprinkler having a flexible stem, which is more robust than traditional, rigid stems.

SUMMARY OF THE INVENTION

Embodiments of the invention provide an irrigation pop-up with a flexible stem, which may be a conventional or pulsating irrigation sprayer or sprinkler. The flexible stem enables an extended stem to be bent instead of being severed, as experienced by traditional irrigation systems, if impacted by an outside force, such as being stepped on or driven over.

The irrigation pop-up with a flexible stem usually includes a rigid housing containing a body having a water inlet and a cap having a pop-up outlet, a flexible stem disposed at least partially within the rigid housing, and a spring coiled around the flexible stem and disposed within the rigid housing. The irrigation pop-up usually has a wiper seal and a spraying nozzle. The flexible stem may be used for pulsating irrigation pop-ups or for conventional (i.e., non-pulsating) irrigation pop-ups.

In one embodiment, the flexible stem contains a lower rigid segment having a first passageway extending therethrough from a lower rigid segment inlet to a lower rigid segment outlet, an upper rigid segment having a second passageway extending therethrough from an upper rigid segment inlet to an upper rigid segment outlet, and an elastic hollow member having a channel and coupled to and in fluid communication with the lower rigid segment outlet and the upper rigid segment inlet. A water flow path may extend from the water inlet, through the first passageway within the lower rigid segment, through the channel of the elastic hollow member, through the second passageway within the upper rigid segment, and out through the spraying nozzle.

In another embodiment, the flexible stem may be used in pulsating irrigation pop-ups and contains a lower rigid segment having a first passageway extending therethrough from a lower rigid segment inlet to a lower rigid segment outlet, an upper rigid segment having a second passageway extending therethrough from an upper rigid segment inlet to an upper rigid segment outlet, and an elastic hollow member having a channel and coupled to and in fluid communication with the lower rigid segment outlet and the upper rigid segment inlet. The flexible stem further contains an elastic sleeve at least partially surrounding a rigid insert disposed within the upper rigid segment, the rigid insert contains a first inlet on a bottom surface, a first outlet on a side surface, a second inlet on the side surface, and a second outlet on a top surface.

In another embodiment, the flexible stem may be used for conventional or pulsating irrigation pop-up contains a lower rigid segment containing a first passageway extending therethrough from a lower rigid segment inlet to a lower rigid segment outlet, an upper rigid segment containing a second passageway extending therethrough from an upper rigid segment inlet to an upper rigid segment outlet, and a rubber tube containing a channel and coupled to and in fluid communication with the lower rigid segment outlet and the upper rigid segment inlet, and a water flow path extending from the water inlet, through the first passageway, through the channel, through the second passageway, and to the upper rigid segment outlet. Throughout the various embodiments, the upper rigid segment outlet may be coupled to and in fluid communication with a sprinkler head, a spray head, or other types of nozzle. In one example, the upper rigid segment may be bent at an angle of about 90° or less relative to the lower rigid segment upon the application of an outside force. Upon removal of the outside force, the upper rigid segment resorts back its original position.

The elastic hollow member may be a tube, a hose, a pipe, a conduit, a duct, or derivatives thereof. The elastic hollow member may contain rubber or rubber derivatives (e.g., natural or synthetic), as well as elastic polymers, elastic oligomers, elastic plastics, which may have carbon or silicon backbones. In one example, the elastic hollow member is a rubber tube, and in another example, a flexible plastic tube surrounded by a spring. In one example, the elastic hollow member is cemented or glued to the lower rigid segment outlet and to the upper rigid segment inlet. In another example, the elastic hollow member is coupled to the lower rigid segment outlet by a first fitting and coupled to the upper rigid segment inlet by a second fitting. In other examples, a flow control may be coupled to and in fluid communication with the first passageway within the lower rigid segment.

In some embodiments for a pulsating irrigation pop-up, the flexible stem may contain an elastic sleeve at least partially surrounding a rigid insert. The rigid insert may contain at least a first inlet on a bottom surface, a first outlet on a side surface, a second inlet on the side surface, and a second outlet on a top surface. For example, the rigid insert may contain a water inlet on the bottom surface, one or more outlets on the circumference of the insert, one or more inlets on the circumference of the insert, and a water outlet on the top surface. In one example, a passageway extends between the first inlet and the first outlet of the rigid insert, extends along and between the side surface of the rigid insert and the elastic sleeve, and further extends between the second inlet and the second outlet of the rigid insert. The rigid insert usually contains at least one barb on the side surface, between the first outlet and the second inlet, and under the elastic sleeve.

In other embodiments, the pop-up operates at a relatively low flow as a pulsating irrigation pop-up sprayer or sprinkler. The body of the rigid housing of the pop-up contains a water inlet port disposed between the water inlet and the flexible stem and in fluid communication with the first passageway. The water inlet port is used to restrict water flow rate passing through the body of the pop-up. The water inlet port may have a diameter, for example, within a range from about 2 mm to about 3 mm. In some examples, the body of the irrigation pop-up provides a maximum water flow rate of about 230 liters per hour.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
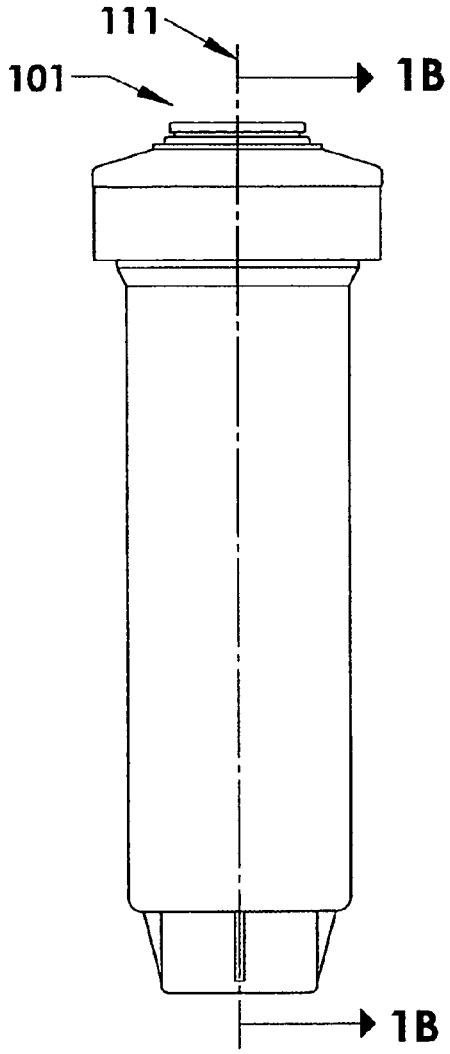
FIGS. 1A-1D depict a pulsating irrigation pop-up according to an embodiment described herein.
Figure 1B:
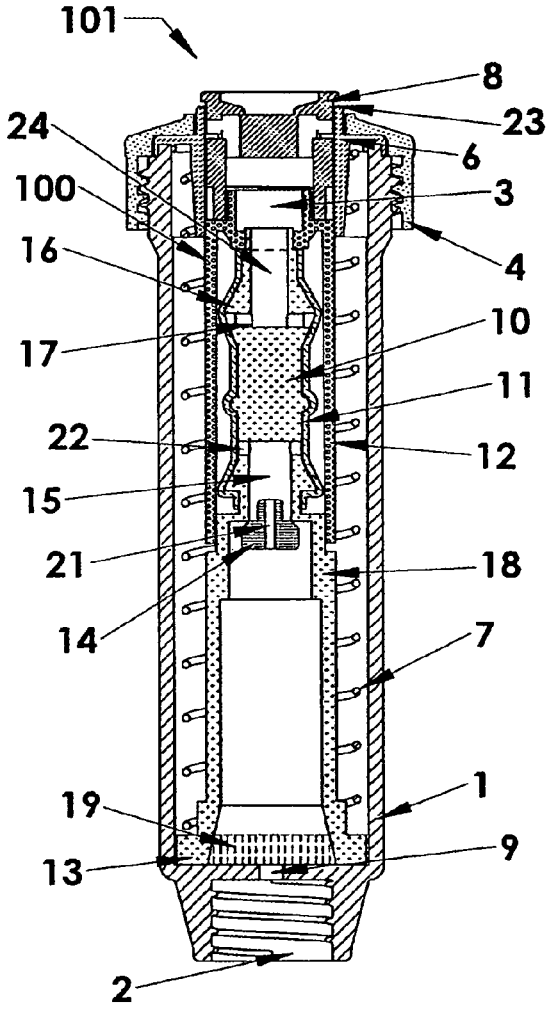

Embodiments of the invention provide an irrigation pop-up sprayer or sprinkler with a flexible stem which may be a pulsating irrigation pop-up or a conventional or non-pulsating irrigation pop-up. FIGS. 1A-1D depict pulsating irrigation pop-up 101, as described in an embodiment herein. FIG. 1A illustrates a front view and FIG. 1B illustrates a cross-sectional view of pulsating irrigation pop-up 101. Pulsating irrigation pop-up 101 contains stem 100 at least partially within body 1 and cap 4. Pulsating irrigation pop-up 101 also contains water inlet 2, outlet port 3, wiper seal 6, spring 7, and spraying nozzle 8. Water inlet 2 is disposed on the bottom of body 1, outlet port 3 is within stem 100 and in fluid communication with spraying nozzle 8, which is disposed at the top of stem 100. Wiper seal 6 is positioned between cap 4 and body 1, while spring 7 coils around stem 100. Spraying nozzle 8 may be a spraying nozzle, a rotating sprinkler, or another type of nozzle. In one example, spraying nozzle 8 may be a floating, rotating sprinkler as further described in commonly assigned U.S. Pat. No. 5,803,365, which is incorporated herein by reference.

In another embodiment, stem 100 contains upper casing 12, lower casing 18, and elastic sleeve 11 at least partially surrounding rigid insert 10. Upper casing 12 is coupled to lower casing 18 and contains rigid insert 10 and elastic sleeve 11. In another example, upper casing 12 may contain vents along the side (not shown). Further disclosure of casings that may be used in embodiments herein is described in commonly assigned U.S. Pat. Nos. 5,507,436 and 5,727,733, which are incorporated herein by reference.

Rigid insert 10 is at least partially surrounded by elastic sleeve 11 and contains inlet port 15, outlet port 22, inlet port 17, and outlet port 24. Rigid insert 10 also has at least one barb 16 that is tightly surrounded by elastic sleeve 11 when closing water inlet port 17 to outlet port 24 and outlet port 3. Flow control or dripper 14 containing passageway 21 is coupled to and in fluid communication with inlet port 15 and is used for controlling the flow of water into the upper section segment of stem 100. In some examples, flow control or dripper 14 may be a nozzle or a dripper. Lower segment 13 of stem 100 serves as a guide for controlling the direction in which stem 100 moves up and down inside of body 1. Slots 19 on lower segment 13 control the movement of stem 100 inside body 1 of pulsating irrigation pop-up 101.

Figure 1C:
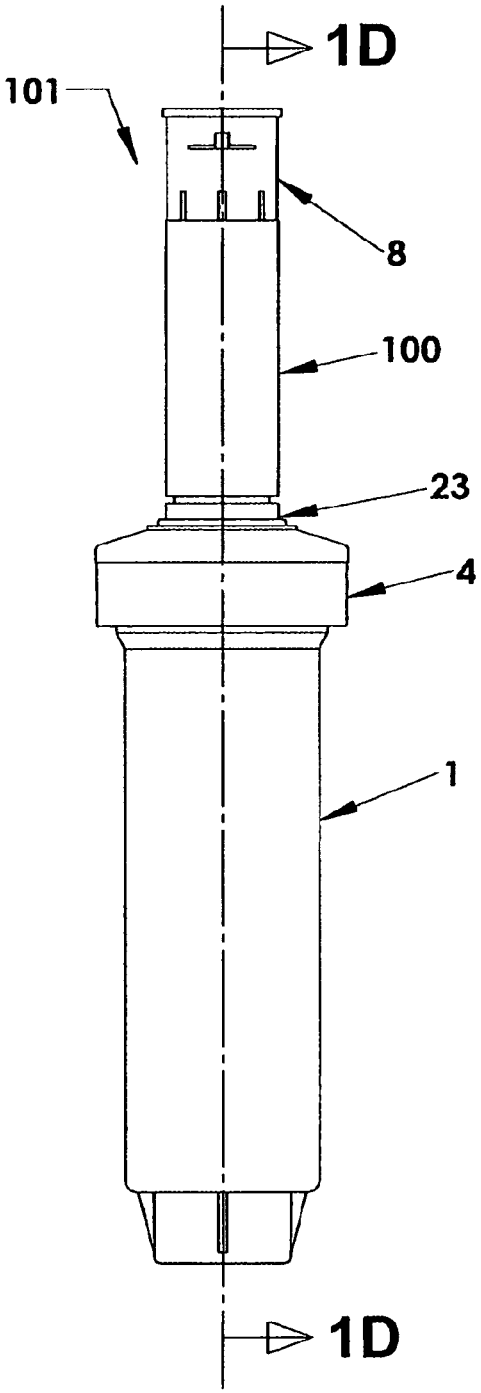
Figure 1D:
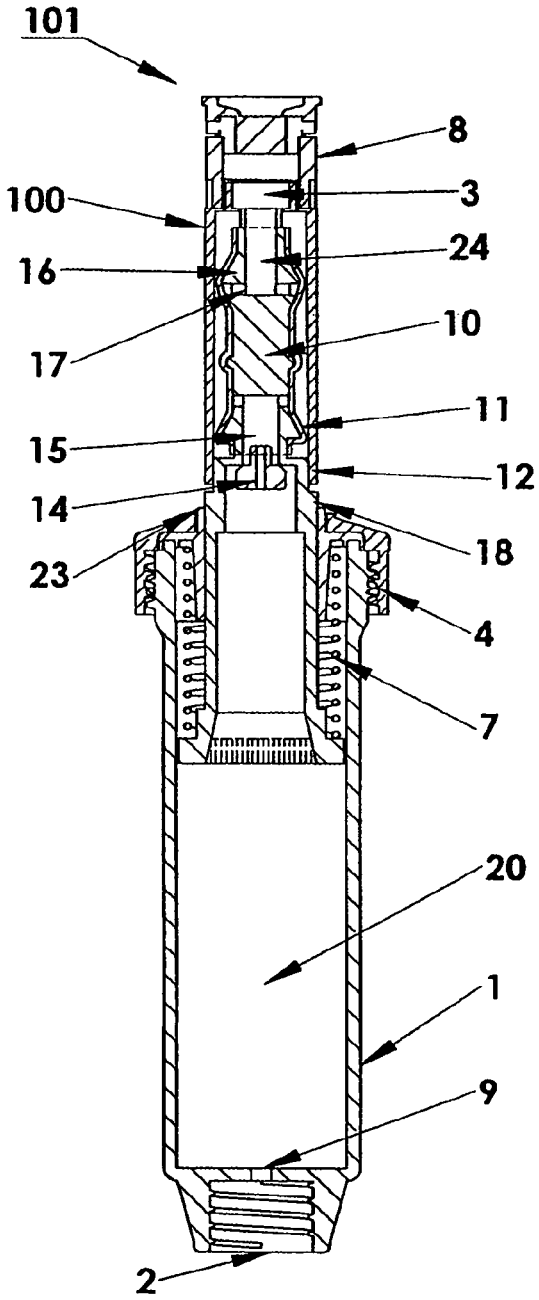

FIGS. 1C-1D illustrate pulsating irrigation pop-up 101 at a position in which stem 100 is extended from body 1 through pop-up outlet 23 to provide increased height for spraying nozzle 8. In one example, stem 100 is extended to provide the highest position for spraying nozzle 8. Water that flows into body 1 through water inlet 2 and water inlet port 9 fills space 20 of body 1. Initially, the water pressure in space 20 is low and elastic sleeve 11 tightly surrounds barb 16 of insert 10 closing water inlet port 17 to outlet port 3. The water which flows through water inlet 2 forces stem 100 to rise. Once the water pressure in space 20 has increased, water flows from space 20 through flow control or dripper 14 into inlet port 15 forcing elastic sleeve 11 to expand and accumulate a small volume of water. As the water pressure increases, elastic sleeve 11 expands enough to open inlet port 17 and force the water to flow through outlet port 24, then through outlet port 3, and out spraying nozzle 8. Since water continues to flow through inlet port 15 at a relatively low controlled flow, elastic sleeve 11 contracts, closing inlet port 17 to outlet port 3 and terminating one pulsating cycle. The preset water pressure of pulsating irrigation pop-up 101 is correlated to the diameter of barb 16 and to the dimension and the physical properties of the elastic sleeve 11.

The pulsating irrigation pop up converts a low continues flow entering its inlet to a high intermittent pulsating flow ejected through its outlet. For example, when dripper 14 controls the flow into flexible stem.

In another embodiment, body 1 of pulsating irrigation pop-up 101 contains water inlet port 9 in fluid communication between water inlet 2 and stem 100. Water inlet port 9 limits the flow of water into body 1 to a maximum flow of, for example, 230 liters per hour. Water inlet port 9 may have a diameter within a range from about 0.5 mm to about 5 mm, preferably, about 2 mm to 3 mm.

Examples provide that pulsating irrigation pop-up 101 receives a continuous flow of water entering water inlet 2 and converts the continuous water flow to an intermittent and pulsating high flow ejected through spraying nozzle 8 at a high intermittent pulsating flow. The flow of water through pulsating irrigation pop-up 101 is controlled and limited to a relatively low flow, for example, at about 12 liters per hour (L/hr). In one example, the total flow for operating a lateral irrigation system containing about 25 such pulsating irrigation pop-ups is only 300 L/hr.

In such a case, if the port at the inlet to the body of the pulsating irrigation pop-ups will have the same diameter of traditional pop-up spraying devices, which is about 1 centimeter to 1.5 centimeter, and if the stem of one of the traditional pulsating irrigation pop-up breaks, water at a relatively high flow rate will be dispersed through the pulsating irrigation pop-up with the broken stem. The pressure in the irrigation lateral will drop and all the other traditional pop-ups in the irrigation system will stop working. Small Inlet port 9 limits the water flow through the pop-up. If a stem of one or more of the current pulsating irrigation pop-ups breaks, the rest of the pulsating irrigation pop-ups will continue to operate.

Each pulsating irrigation pop-up 101 may utilize stem 100 as a preset pressure responding valve. At any pressure lower than a preset pressure, outlet port 3 within pulsating irrigation pop-up 101 remains closed and no water flows from water inlet 2 to outlet port 3. Therefore, a relatively low flow of water causes stem 100 to move to an extended position.

In one example, an irrigation system contains multiple pulsating irrigation pop-up assemblies 101, for example, about 25 assemblies. If one or more stems 100 break, the water pressure in the lateral will drop only slightly, and all the rest of pulsating irrigation pop-up assemblies 101 in the irrigation system will continue to operate. The flow into body 1 of pulsating irrigation pop-up 101 is controlled and limited by water inlet port 9. The water flows into body 1 of pulsating irrigation pop-up 101 may also be controlled by flow control or dripper 14 or an orifice at or near inlet 2.

Figure 2A:
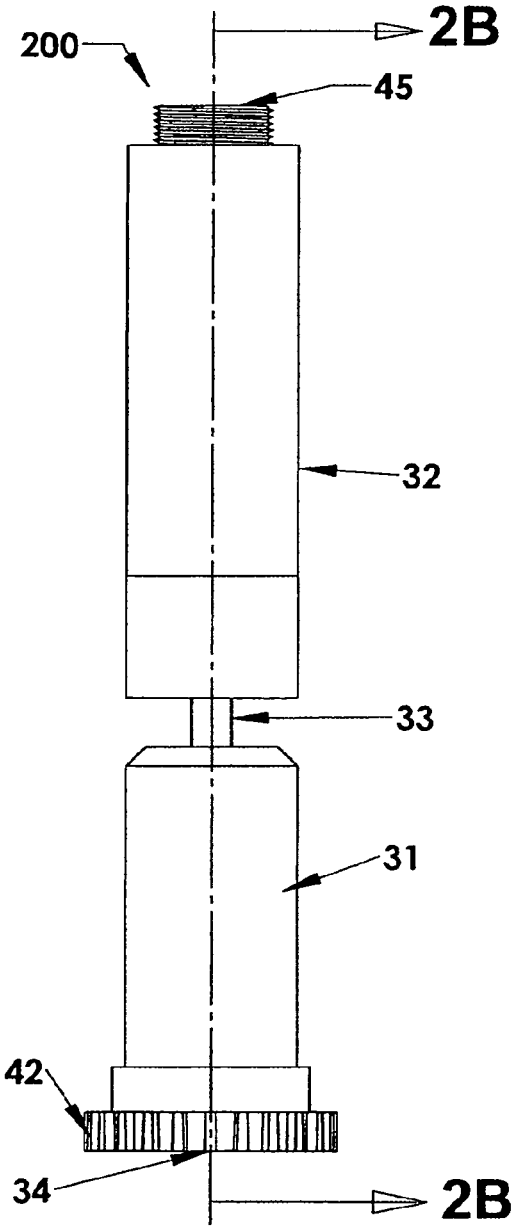
FIGS. 2A-2B depict a flexible stem according to an embodiment described herein.
Figure 2B:
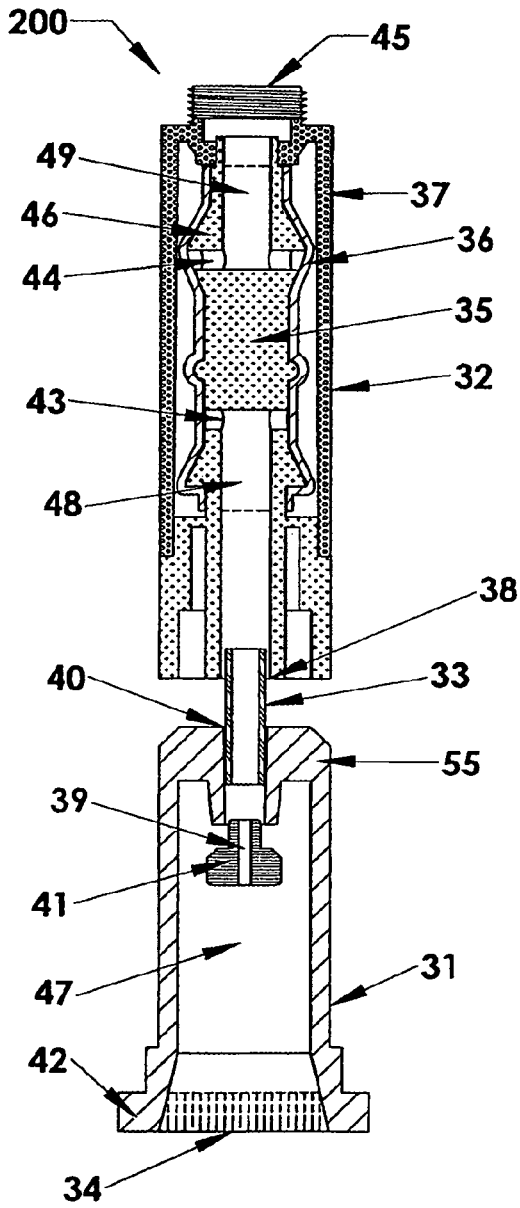
Figure 2C:
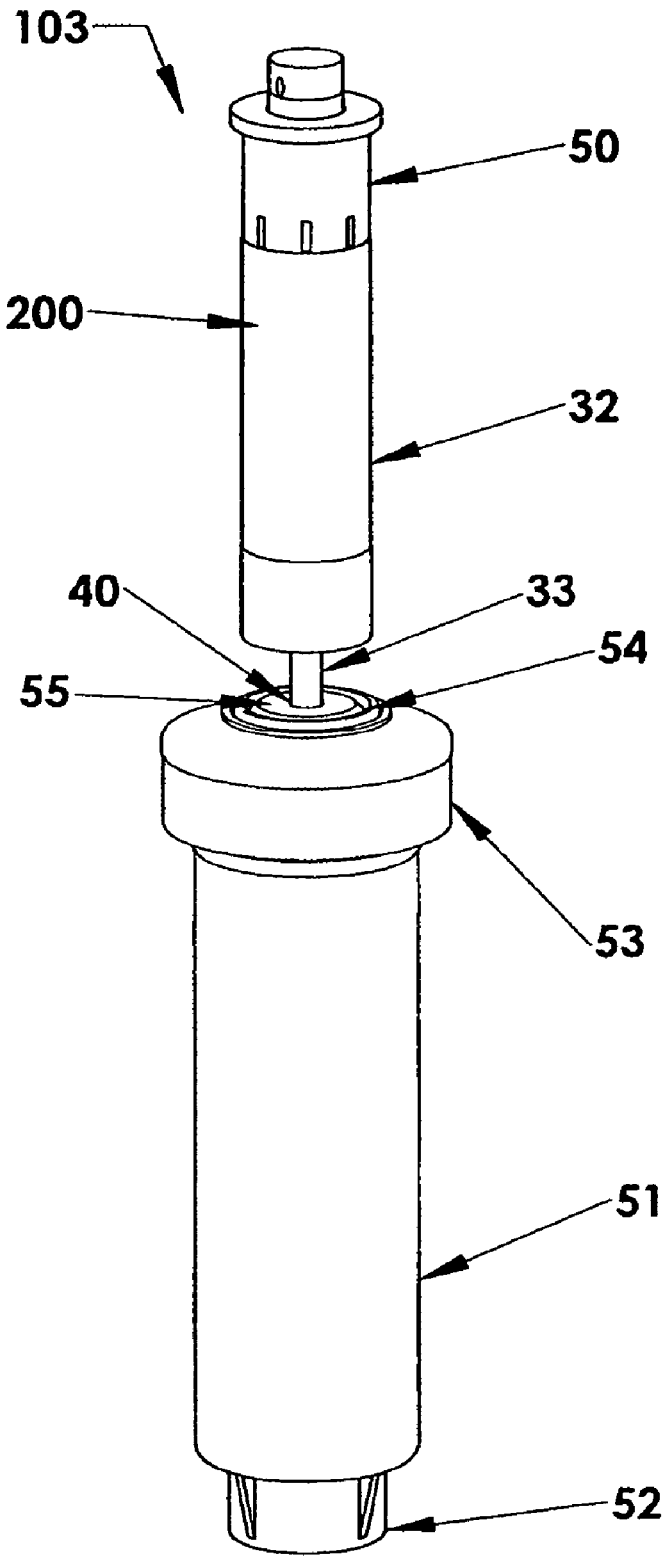
FIG. 2C depicts another pulsating irrigation pop-up according to an embodiment described herein.

In another embodiment, FIGS. 2A-2B depict flexible stem 200, which may be used in pulsating irrigation pop-up 102, as illustrated in FIG. 2C. Flexible stem 200 contains lower rigid segment 31 and upper rigid segment 32, both connected by elastic hollow member 33 (e.g., rubber tube). Lower rigid segment 31 contains water inlet 34 which is in fluid communication with water outlet 45 of upper rigid segment 32. In one embodiment, flexible stem 200 contains lower rigid segment 31 having passageway 47 extending from water inlet 34 to outlet port 40 and upper rigid segment 32 having passageway 48 extending from inlet port 38 to water outlet port 49. Elastic hollow member 33 has a channel therethrough and is coupled to and in fluid communication with outlet port 40 of lower rigid segment 31 and inlet port 38 of upper rigid segment 32. Flexible stem 200 further has elastic sleeve 36 at least partially surrounding rigid insert 35 and disposed within upper rigid segment 32. Rigid insert 35 contains inlet port 38 on a bottom surface, outlet 43 on a side surface, inlet 44 also on the side surface, and water outlet port 49 on a top surface.

Elastic hollow member 33 has a channel and has elastic properties, such as being capable of returning to an original length or shape after being stretched, deformed, compressed, or expanded by an outside force. Elastic hollow member 33 may be a tube, a flexible tube, a hose, a pipe, a conduit, a duct, or derivatives thereof. Elastic hollow member 33 may contain a material such as rubber or a rubber derivative (e.g., natural or synthetic rubber), an elastic polymer, an elastic oligomer, an elastic plastic, derivatives thereof, or combinations thereof. The rubber, polymer, or other material contained within elastic hollow member 33 may have a carbon backbone or a silicon backbone. In some embodiments, elastic hollow member 33 may be reinforced by a spring disposed inside, outside, or embedded within elastic hollow member 33. In one example, elastic hollow member 33 is a tube or hose containing rubber or a rubber derivative. In some examples, elastic hollow member 33 is a flexible tube, such as a flexible plastic tube. In some examples, elastic hollow member is cemented, glued, or welded to a lower rigid segment outlet, such as outlet port 40 and to an upper rigid segment inlet, such as inlet port 38. In another example, elastic hollow member 33 is coupled to a lower rigid segment outlet, such as outlet port 40 by a first fitting (not shown) and coupled to an upper rigid segment inlet, such as inlet port 38 by a second fitting (not shown). Further disclosure of pulsating irrigation devices for converting a low continues flow to high intermittent pulsating flow that may be used in embodiments herein are further described commonly assigned U.S. Pat. Nos. 5,507,436 and 5,727,733, which are incorporated herein by reference.

In some examples, flow control 41, having passageway 39, may be coupled to lower casing 55 and in fluid communication with passageway 47 within lower rigid segment 31. Flow control 41 directs or controls the flow of water into upper rigid segment 32 of flexible stem 200. Slots 42 on lower rigid segment 31 control the movement of flexible stem 200 inside body 51 of pulsating irrigation pop-up 102.

FIG. 2C illustrates pulsating irrigation pop-up 102 at a position in which a portion of flexible stem 200 is extended from body 51 and cap 53 through pop-up outlet 54 of cap 53 to provide increased height for sprinkler head 50. In one example, stem 200 is extended to provide the highest position for sprinkler head 50. The portion of flexible stem 200 extended or protruding through pop-up outlet 54 includes upper rigid segment 32 and elastic hollow member 33. Upper rigid segment 32 of flexible stem 200 is coupled to lower rigid segment 31 of flexible stem 200 by elastic hollow member 33. In the extended position, upper rigid segment 32 of flexible stem 200 may be bent, as much as 90°, by an external force. Upon removal of the external force, flexible stem 200 returns to its original position as illustrated in FIG. 2C. Therefore, upper rigid segment 32 may be bent at an angle of about 90° or less relative to lower rigid segment 31 upon the applied outside force. In one example, sprinkler head 50 is a floating rotating sprinkler head.

Water flows into body 51 through water inlet 52 to increase the water pressure within body 51. Initially, the water pressure is low therefore the water flowing through water inlet 52 forces flexible stem 200 to extend through pop-up outlet 54. Once the water pressure in body 51 has increased, water flows from within body 51 through water inlet 34, through passageway 47, through passageway 39 of flow control 41 out of lower rigid segment 31 through outlet port 40. Subsequently, the water passes though elastic hollow member 33 and enters into upper rigid segment 32 by inlet port 38.

Initially, flexible stem 200 is extended because the water pressure is low and elastic sleeve 36 tightly surrounds barb 46 of rigid insert 35 closing inlet port 44 to outlet port 49. The water travels from inlet port 38, through passageway 48, and through outlet port 43 forcing elastic sleeve 36 to expand and accumulate water. As the water pressure increases, elastic sleeve 36 expands enough to open inlet port 44 and force the water to flow through outlet port 49, then through water outlet 45, and out sprinkler head 50. Since water continues to flow through passageway 48 at a relatively low controlled flow, elastic sleeve 36 contracts, closing inlet port 44 to outlet port 49 and terminating one pulsating cycle. The preset water pressure of pulsating irrigation pop-up 102 is correlated to the diameter of barb 46 and to the dimension and the physical properties of the elastic sleeve 36.

Figure 3A:
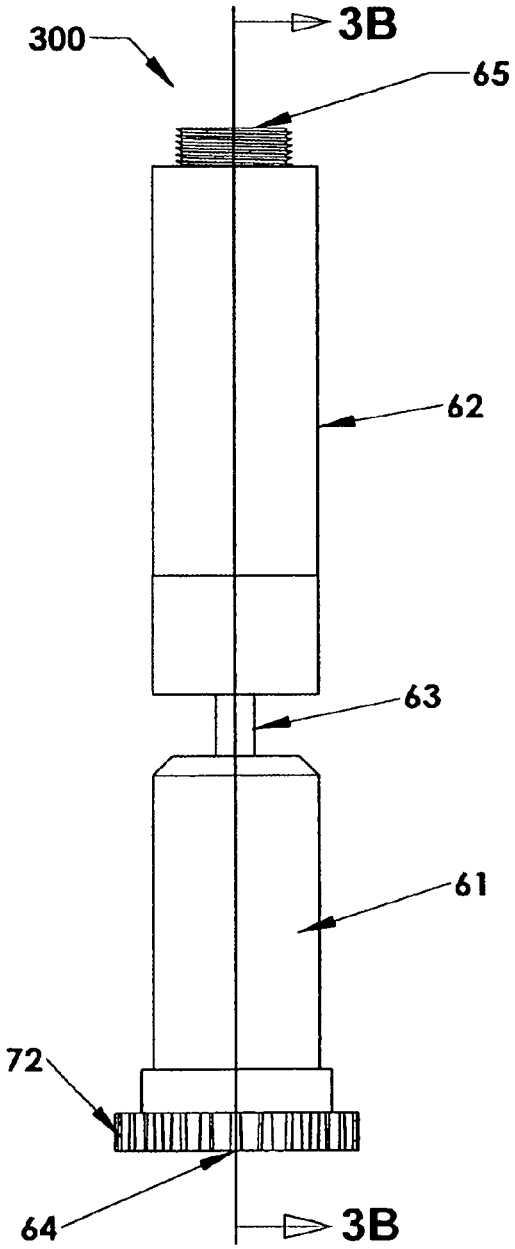
FIGS. 3A-3B depict a conventional flexible stem according to an embodiment described herein.
Figure 3B:
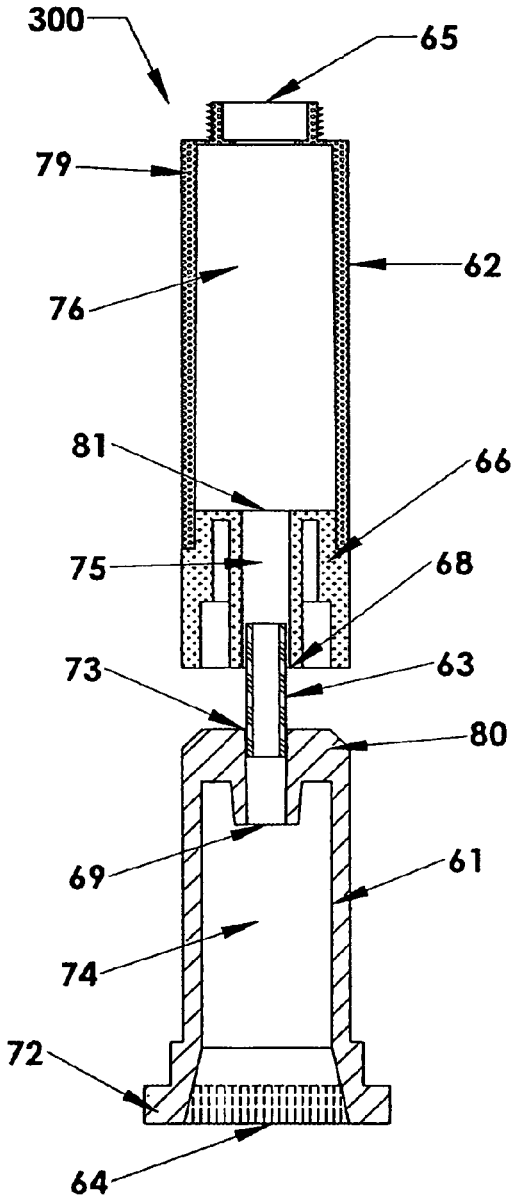
Figure 3C:
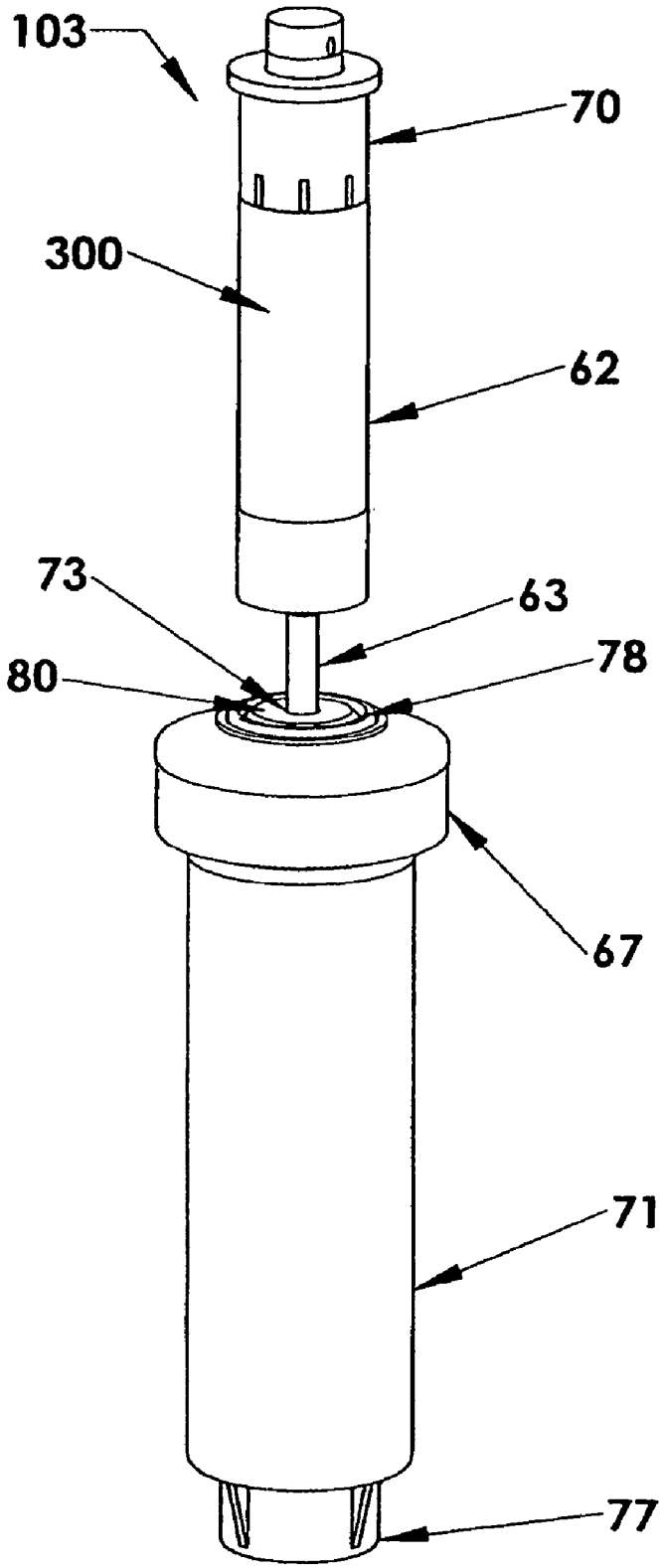
FIG. 3C depicts a non-pulsating irrigation pop-up according to an embodiment described herein.

In another embodiment, FIGS. 3A-3B depict flexible stem 300, which is a conventional, i.e., non-pulsating, flexible pop-up stem. Flexible stem 300 may be used in non-pulsating irrigation pop-up 103, as illustrated in FIG. 3C. Flexible stem 300 contains lower rigid segment 61 and upper rigid segment 62, both connected to elastic hollow member 63 (e.g., rubber tube). Elastic hollow member 63 has a channel therethrough and is coupled to and in fluid communication with outlet port 73 of lower rigid segment 61 and inlet port 68 of upper rigid segment 62.

Lower rigid segment 61 contains lower casing 80 having passageway 74 extending from water inlet 64, through port 69, and to outlet port 73. Slots 72 on lower rigid segment 61 control the movement of flexible stem 300 inside body 71 of non-pulsating irrigation pop-up 103. Upper rigid segment 62 contains insert 66 coupled to and in fluid communication with upper casing 79. Insert 66 contains inlet port 68 on a bottom surface, channel 75 extending therethrough, and outlet 81 on a top surface. Upper casing 79 has passageway 76 extending therethrough and in fluid communication with outlet 81 of insert 66 and water outlet 65 disposed on the top of upper casing 79.

Elastic hollow member 63 has a channel and has elastic properties, such as being capable of returning to an original length or shape after being stretched, deformed, compressed, or expanded by an outside force. Elastic hollow member 63 may be a tube, a flexible tube, a hose, a pipe, a conduit, a duct, or derivatives thereof. Elastic hollow member 63 may contain a material such as rubber or a rubber derivative (e.g., natural or synthetic rubber), an elastic polymer, an elastic oligomer, an elastic plastic, derivatives thereof, or combinations thereof. The rubber, polymer, or other material contained within elastic hollow member 63 may have a carbon backbone or a silicon backbone. In some embodiments, elastic hollow member 63 may be reinforced by a spring disposed inside, outside, or embedded within elastic hollow member 63. In one example, elastic hollow member 63 is a tube or hose containing rubber or a rubber derivative. In some examples, elastic hollow member 63 is a flexible tube, such as a flexible plastic tube. In some examples, elastic hollow member is cemented, glued, or welded to a lower rigid segment outlet, such as outlet port 73 and to an upper rigid segment inlet, such as inlet port 68. In another example, elastic hollow member 63 is coupled to a lower rigid segment outlet, such as outlet port 73 by a first fitting (not shown) and coupled to an upper rigid segment inlet, such as inlet port 68 by a second fitting (not shown).

FIG. 3C illustrates non-pulsating irrigation pop-up 103 at a position in which a portion of flexible stem 300 is extended from body 71 and cap 67 through pop-up outlet 78 of cap 67 to provide increased height for spray head 70. In one example, stem 300 is extended to provide the highest position for sprayer head 70. The portion of flexible stem 300 extended or protruding through pop-up outlet 78 includes upper rigid segment 62 and elastic hollow member 63. Upper rigid segment 62 of flexible stem 300 is coupled to lower rigid segment 61 of flexible stem 300 by elastic hollow member 63. In the extended position, upper rigid segment 62 of flexible stem 300 may be bent, as much as 90°, by an external force. Upon removal of the external force, flexible stem 300 returns to its original position as illustrated in FIG. 3C. Therefore, upper rigid segment 62 may be bent at an angle of about 90° or less relative to lower rigid segment 61 upon the applied outside force.

Water flows into body 71 through water inlet 77 to increase the water pressure within body 71. Initially, the water pressure is low therefore the water flowing through water inlet 77 forces flexible stem 300 to extend through pop-up outlet 78. Once the water pressure in body 71 has increased, water flows from within body 71 through water inlet 64, through passageway 74, through port 69, and out of lower rigid segment 61 through outlet port 73. Subsequently, the water passes though elastic hollow member 63 and enters into upper rigid segment 62 by inlet port 68. Thereafter, the water travels from inlet port 68, through channel 75, through outlet 81, through passageway 76, and out spray head 70.

Figure 4A:
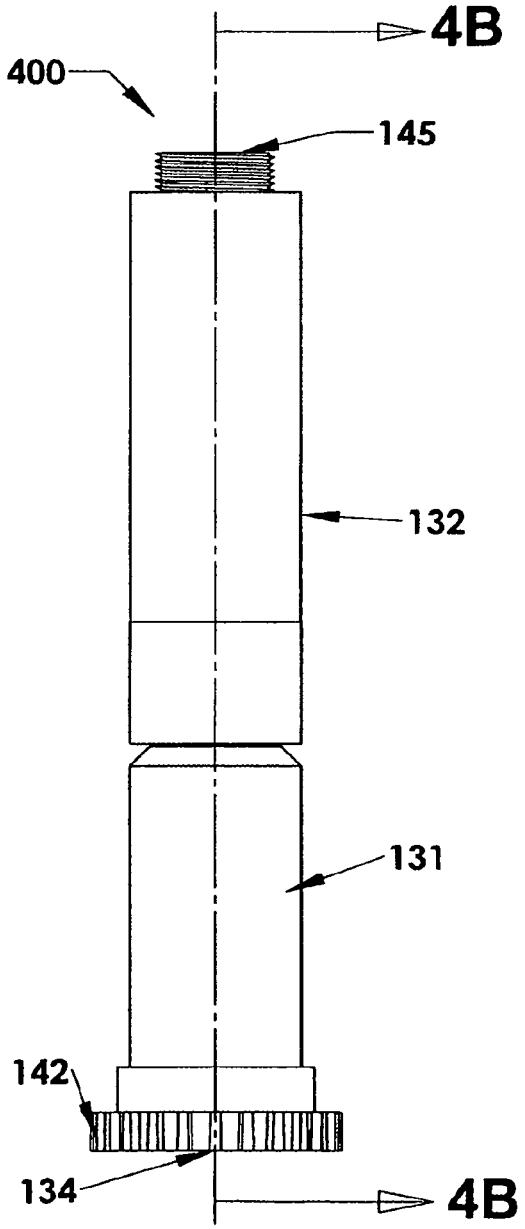
FIGS. 4A-4B depict another flexible stem according to an embodiment described herein.
Figure 4B:
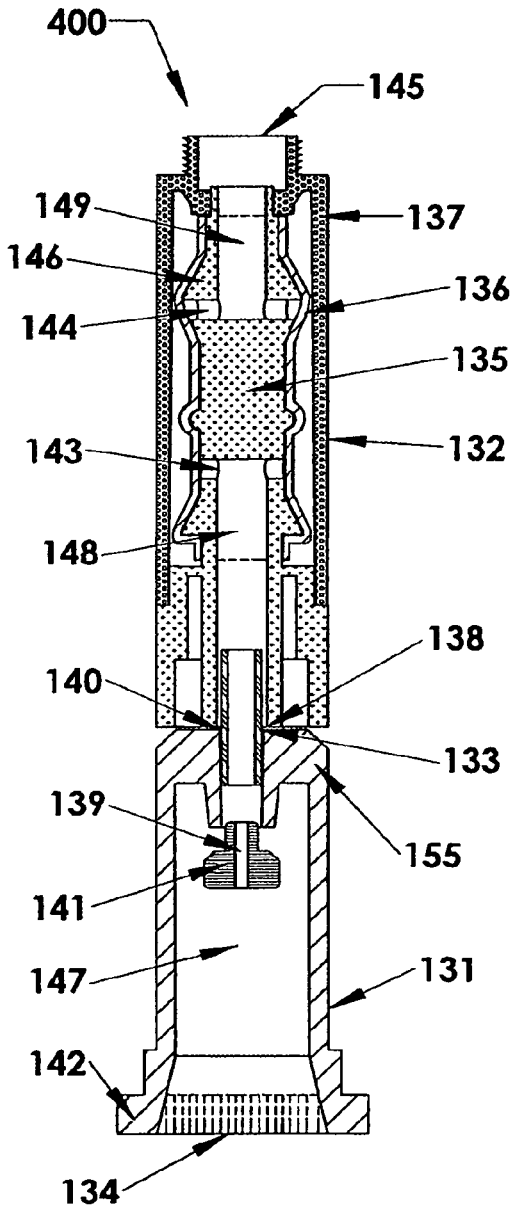
Figure 4C:
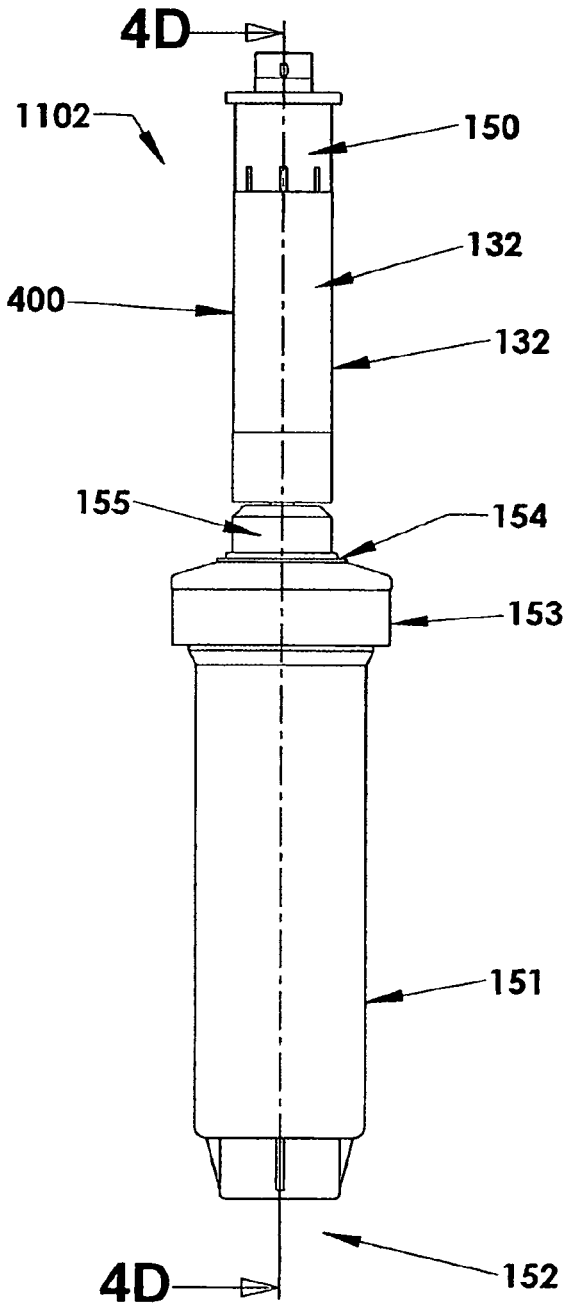
FIGS. 4C-4E depict another pulsating irrigation pop-up according to an embodiment described herein.
Figure 4D:
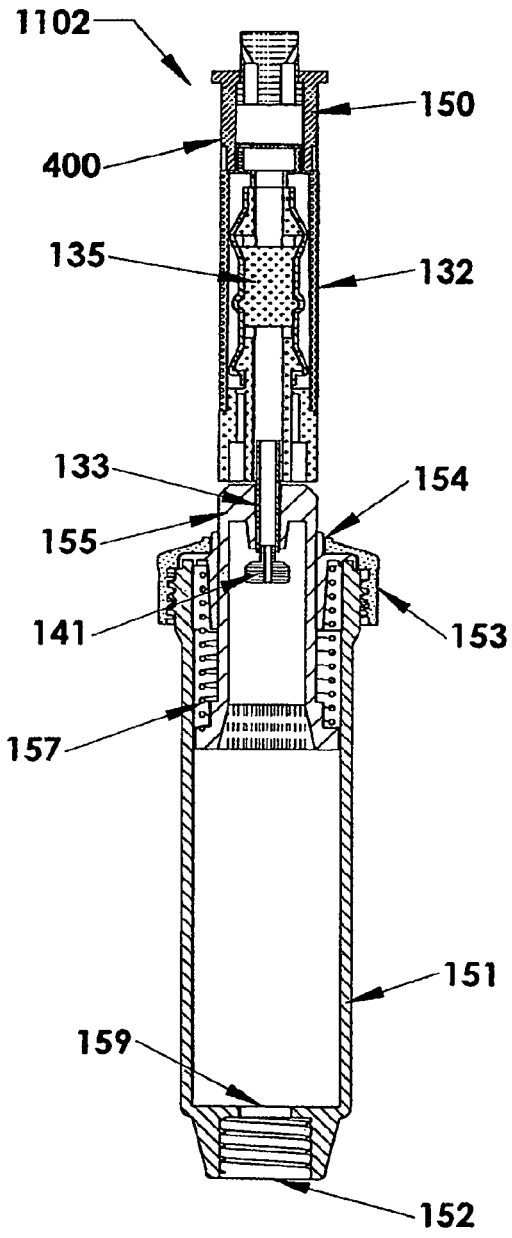
Figure 4E:
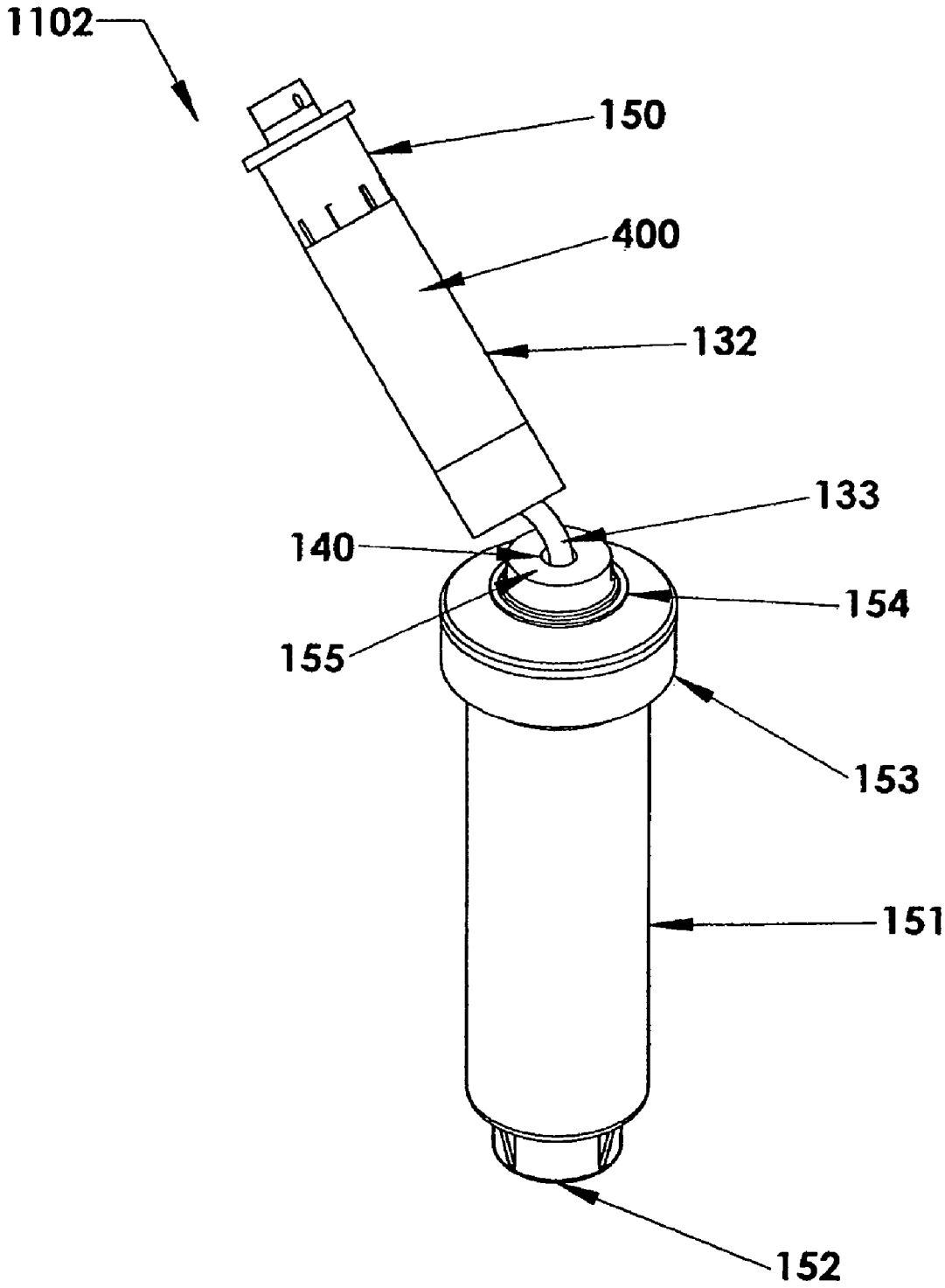

In another embodiment, FIGS. 4A-4B depict flexible stem 400, which is a pulsating flexible pop-up stem. Flexible stem 400 may be used in pulsating irrigation pop-up 1102, as illustrated in FIGS. 4C-4E. Flexible stem 400 contains lower rigid segment 131 and upper rigid segment 132, both connected by elastic hollow member 133 (e.g., rubber tube). Lower rigid segment 131 contains water inlet 134 which is in fluid communication with water outlet 145 of upper rigid segment 132. In one embodiment, flexible stem 400 contains lower rigid segment 131 having passageway 147 extending from water inlet 134 to outlet port 140 and upper rigid segment 132 having passageway 148 extending from inlet port 138 to water outlet port 149. Elastic hollow member 133 has a channel therethrough and is coupled to and in fluid communication with outlet port 140 of lower rigid segment 131 and inlet port 138 of upper rigid segment 132. Flexible stem 400 further has elastic sleeve 136 at least partially surrounding rigid insert 135 and disposed within upper rigid segment 132. Rigid insert 135 contains inlet port 138 on a bottom surface, outlet 143 on a side surface, inlet 144 also on the side surface, and water outlet port 149 on a top surface.

Elastic hollow member 133 has a channel and has elastic properties, such as being capable of returning to an original length or shape after being stretched, deformed, compressed, or expanded by an outside force. Elastic hollow member 133 may be a tube, a flexible tube, a hose, a pipe, a conduit, a duct, or derivatives thereof. Elastic hollow member 133 may contain a material such as rubber or a rubber derivative (e.g., natural or synthetic rubber), an elastic polymer, an elastic oligomer, an elastic plastic, derivatives thereof, or combinations thereof. The rubber, polymer, or other material contained within elastic hollow member 133 may have a carbon backbone or a silicon backbone. In some embodiments, elastic hollow member 133 may be reinforced by a spring disposed inside, outside, or embedded within elastic hollow member 133. In one example, elastic hollow member 133 is a tube or hose containing rubber or a rubber derivative. In some examples, elastic hollow member 133 is a flexible tube, such as a flexible plastic tube. In some examples, elastic hollow member is cemented, glued, or welded to a lower rigid segment outlet, such as outlet port 140 and to an upper rigid segment inlet, such as inlet port 138. In another example, elastic hollow member 133 is coupled to a lower rigid segment outlet, such as outlet port 140 by a first fitting (not shown) and coupled to an upper rigid segment inlet, such as inlet port 138 by a second fitting (not shown). Further disclosure of pulsating irrigation devices for converting a low continues flow to high intermittent pulsating flow that may be used in embodiments herein are further described commonly assigned U.S. Pat. Nos. 5,507,436 and 5,727,733, which are incorporated herein by reference.

In some examples, flow control or dripper 141, having passageway 139, may be coupled to lower casing 155 and in fluid communication with passageway 147 within lower rigid segment 131. Flow control or dripper 141 directs or controls the flow of water into upper rigid segment 132 of flexible stem 400. Slots 142 on lower rigid segment 131 control the movement of flexible stem 400 inside body 151 of pulsating irrigation pop-up 1102.

FIGS. 4C-4E illustrates pulsating irrigation pop-up 1102 at a position in which a portion of flexible stem 400 is extended from body 151 and cap 153 through pop-up outlet 154 of cap 153 to provide increased height for sprinkler head 150. In one example, stem 400 is extended to provide the highest position for sprinkler head 150. The portion of flexible stem 400 extended or protruding through pop-up outlet 154 includes upper rigid segment 132 and elastic hollow member 133, as well as a portion of lower casing 155 of lower rigid segment 131. Upper rigid segment 132 of flexible stem 400 is coupled to lower rigid segment 131 of flexible stem 400 by elastic hollow member 133. In one example, sprinkler head 150 is a floating rotating sprinkler head. Pulsating irrigation pop-up 1102 also contains spring 157 coiled around flexible stem 400 and a wiper seal within cap 153.

Water flows into body 151 through water inlet 152 and inlet port 159 to increase the water pressure within body 151. Initially, the water pressure is low therefore the water flowing through water inlet 152 forces flexible stem 400 to extend through pop-up outlet 154. Once the water pressure in body 151 has increased, water flows from within body 151 through water inlet 134, through passageway 147, through passageway 139 of flow control or dripper 141 out of lower rigid segment 131 through outlet port 140. Subsequently, the water passes though elastic hollow member 133 and enters into upper rigid segment 132 by inlet port 138.

Initially, flexible stem 400 is extended because the water pressure is low and elastic sleeve 136 tightly surrounds barb 146 of rigid insert 135 closing inlet port 144 to outlet port 149. The water travels from inlet port 138, through passageway 148, and through outlet port 143 forcing elastic sleeve 136 to expand and accumulate water. As the water pressure increases, elastic sleeve 136 expands enough to open inlet port 144 and force the water to flow through outlet port 149, then through water outlet 145, and out sprinkler head 150. Since water continues to flow through passageway 148 at a relatively low controlled flow, elastic sleeve 136 contracts, closing inlet port 144 to outlet port 149 and terminating one pulsating cycle. The preset water pressure of pulsating irrigation pop-up 1102 is correlated to the diameter of barb 146 and to the dimension and the physical properties of the elastic sleeve 136.

A relatively low continuous flow of water which enters through the inlet of pulsating irrigation pop-up 1102 ejects at a high intermittent pulsating flow through its outlet.

FIG. 4E illustrates pulsating irrigation pop-up 1102 at a position in which extended flexible stem 400 is bent by an external force, such as being stepped on or driven over. Elastic hollow member 133 slightly elongates and upper rigid segment 132 of flexible stem 400 bends as the external force is applied thereto. In one embodiment, flexible stem 400 and elastic hollow member 133 may be bent as much as about 90°, such that flexible stem 400 is lying on the ground. Therefore, upper rigid segment 132 may be bent at an angle of about 90° or less relative to lower rigid segment 131 upon the applied outside force. When the external force is removed, elastic hollow member 133 contracts and upper rigid segment 132 of flexible stem 400 return to its original position as depicted in FIG. 4C. Pulsating irrigation pop-up 1102 having flexible stem 400 is much more robust than an irrigation system having a rigid, non-flexible, or non-elastic stem due to the drastically reduction in the possibility of breaking flexible stem 400.

Figure 4F:
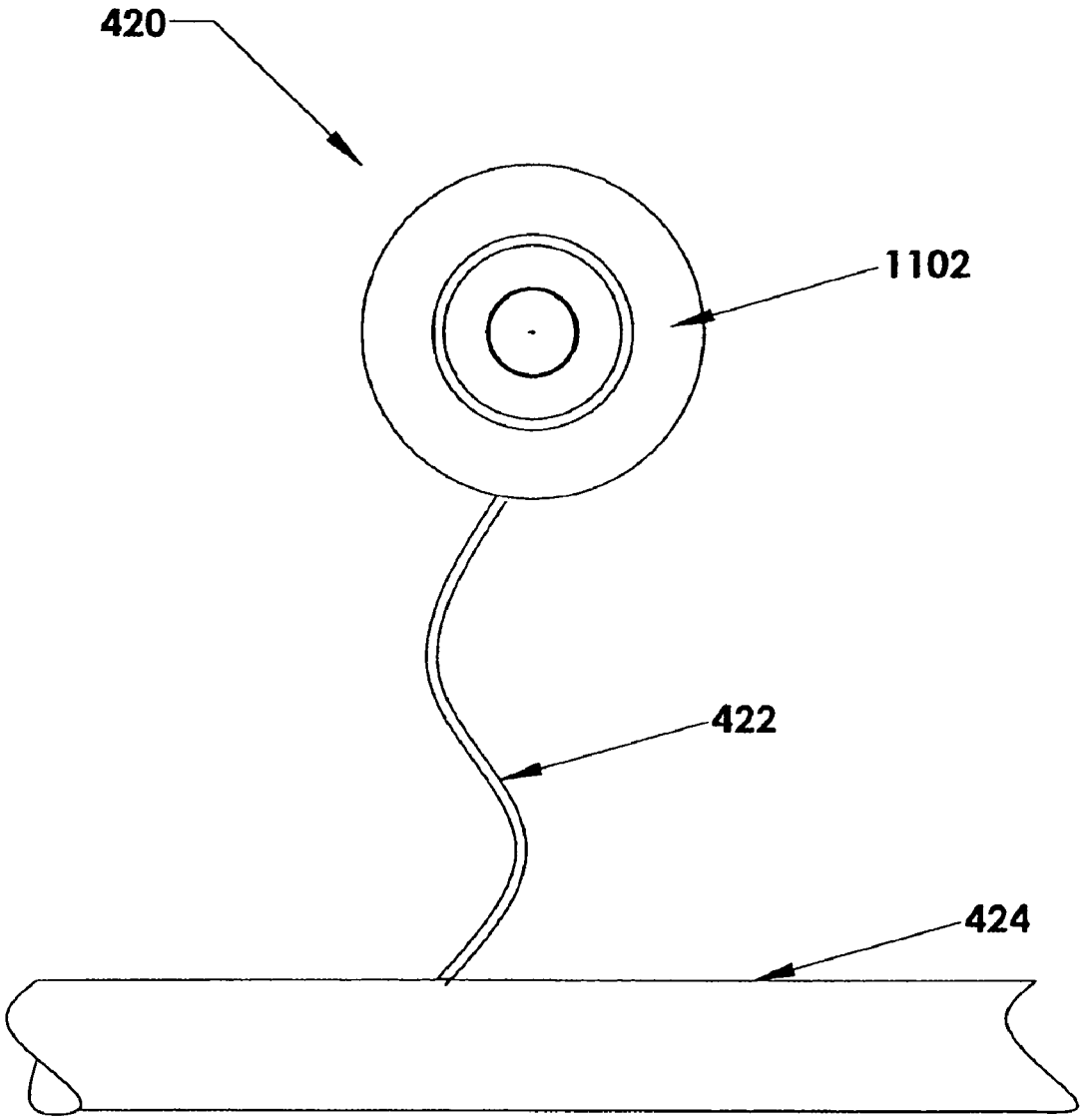
FIG. 4F depicts an irrigation system according to an embodiment described herein.

FIG. 4F depicts an irrigation system according to another embodiment. FIG. 4F illustrates, in a top view, irrigation system 420 containing pulsating irrigation pop-ups 1102 coupled to and in fluid communication with flexible tubing 422, which is coupled to and in fluid communication with irrigation lateral 424. The small size of flexible tubing 422 may be used to restrict the flow of water from irrigation lateral 424 to pulsating irrigation pop-up 1102. Also, flexible tubing 422 is useful for better locating pulsating irrigation pop-up 1102 at the desirable locations in the field, as opposed to traditional irrigation systems, in which the pop-up is directly connected to a rigid irrigation lateral. Flexible tubing 422 may have a length of about 1 meter, and generally has a small, restricting diameter. The inner diameter of flexible tubing 422 may be within a range from about 2 mm to about 6 mm, preferably, from about 3 mm to about 5 mm, for example, about 4 mm.

Figure 5A:
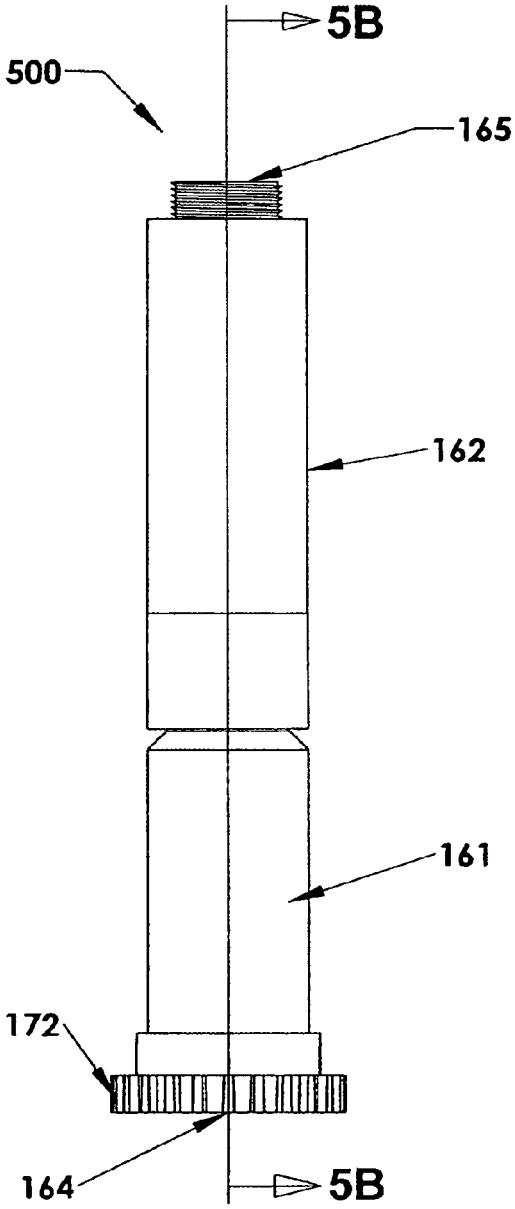
FIGS. 5A-5B depict another conventional flexible stem according to an embodiment described herein.
Figure 5B:
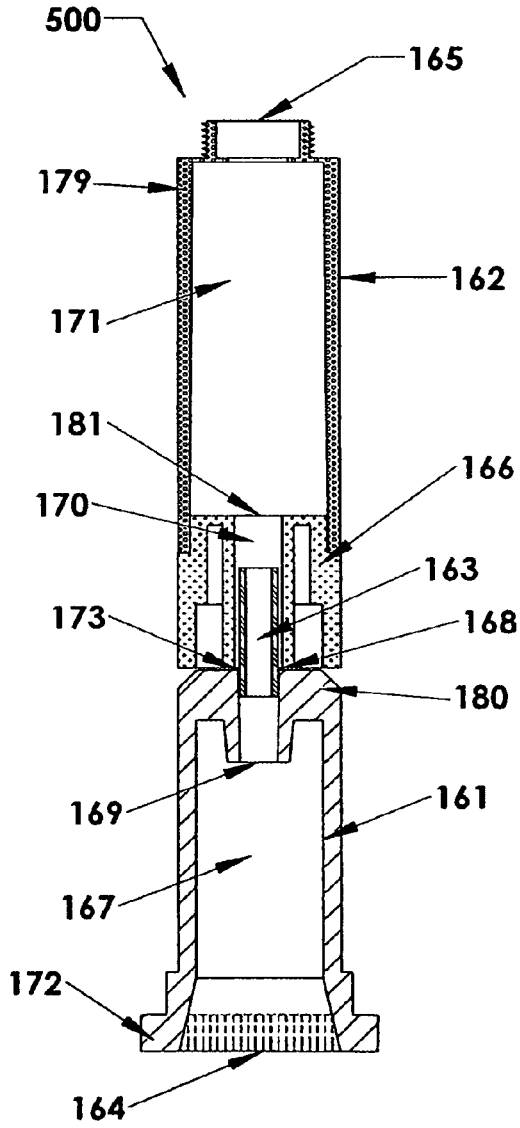
Figure 5C:
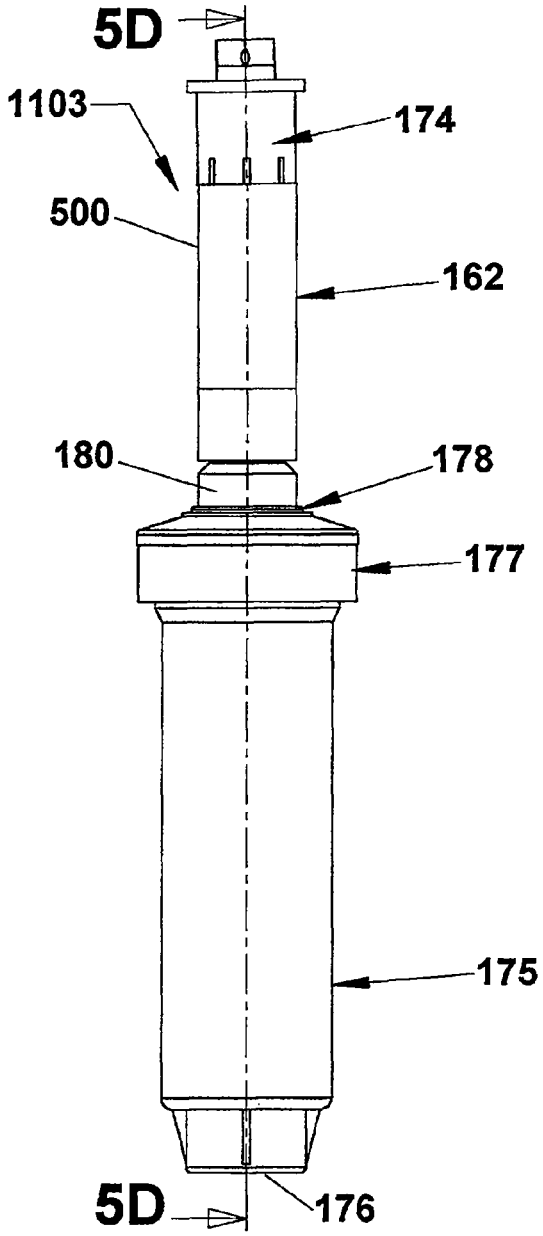
FIGS. 5C-5E depict another non-pulsating irrigation pop-up according to an embodiment described herein.
Figure 5D:
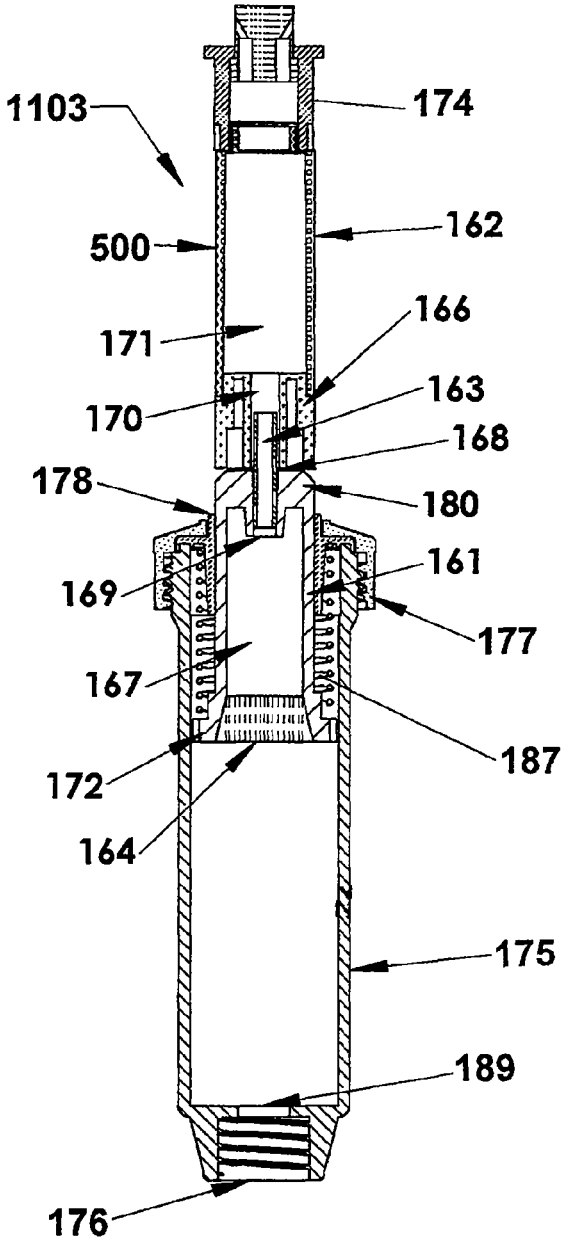

In another embodiment, FIGS. 5A-5B depict flexible stem 500, which is a conventional or non-pulsating, flexible pop-up stem. Flexible stem 500 may be used in non-pulsating irrigation pop-up 1103, as illustrated in FIG. 5C. Flexible stem 500 contains lower rigid segment 161 and upper rigid segment 162, both connected to elastic hollow member 163 (e.g., rubber tube). Elastic hollow member 163 has a channel therethrough and is coupled to and in fluid communication with outlet port 173 of lower rigid segment 161 and inlet port 168 of upper rigid segment 162.

Lower rigid segment 161 contains lower casing 180 having passageway 167 extending from water inlet 164, through port 169, and to outlet port 173. Slots 172 on lower rigid segment 161 control the movement of flexible stem 500 inside body 175 of non-pulsating irrigation pop-up 1103. Upper rigid segment 162 contains insert 166 coupled to and in fluid communication with upper casing 179. Insert 166 contains inlet port 168 on a bottom surface, channel 170 extending therethrough, and outlet 181 on a top surface. Upper casing 179 has passageway 171 extending therethrough and in fluid communication with outlet 181 of insert 166 and water outlet 165 disposed on the top of upper casing 179. Non-pulsating irrigation pop-up 1103 also contains spring 187 coiled around flexible stem 500 and a wiper seal within cap 177.

Elastic hollow member 163 has a channel and has elastic properties, such as being capable of returning to an original length or shape after being stretched, deformed, compressed, or expanded by an outside force. Elastic hollow member 163 may be a tube, a flexible tube, a hose, a pipe, a conduit, a duct, or derivatives thereof. Elastic hollow member 163 may contain a material such as rubber or a rubber derivative (e.g., natural or synthetic rubber), an elastic polymer, an elastic oligomer, an elastic plastic, derivatives thereof, or combinations thereof. The rubber, polymer, or other material contained within elastic hollow member 163 may have a carbon backbone or a silicon backbone. In some embodiments, elastic hollow member 163 may be reinforced by a spring disposed inside, outside, or embedded within elastic hollow member 163. In one example, elastic hollow member 163 is a tube or hose containing rubber or a rubber derivative. In some examples, elastic hollow member 163 is a flexible tube, such as a flexible plastic tube. In some examples, elastic hollow member is cemented, glued, or welded to a lower rigid segment outlet, such as outlet port 173 and to an upper rigid segment inlet, such as inlet port 168. In another example, elastic hollow member 163 is coupled to a lower rigid segment outlet, such as outlet port 173 by a first fitting (not shown) and coupled to an upper rigid segment inlet, such as inlet port 168 by a second fitting (not shown).

FIG. 5C illustrates non-pulsating irrigation pop-up 1103 at a position in which a portion of flexible stem 500 is extended from body 175 and cap 177 through pop-up outlet 178 of cap 177 to provide increased height for spray head 174. In one example, stem 500 is extended to provide the highest position for spray head 174. The portion of flexible stem 500 extended or protruding through pop-up outlet 178 includes upper rigid segment 162 and elastic hollow member 163. Upper rigid segment 162 of flexible stem 500 is coupled to lower rigid segment 161 of flexible stem 500 by elastic hollow member 163.

Water flows into body 175 through water inlet 176 and inlet port 189 to increase the water pressure within body 175. Initially, the water pressure is low therefore the water flowing through water inlet 176 forces flexible stem 500 to extend through pop-up outlet 178. Once the water pressure in body 175 has increased, water flows from within body 175 through water inlet 164, through passageway 167, through port 169, and out of lower rigid segment 161 through outlet port 173. Subsequently, the water passes though elastic hollow member 163 and enters into upper rigid segment 162 by inlet port 168. Thereafter, the water travels from inlet port 168, through channel 170, through outlet 181, through passageway 171, and out spray head 174.

A relatively low continuous flow of water which enters through the inlet of non-pulsating irrigation pop-up 1103 ejects at a high flow through its outlet.

Figure 5E:
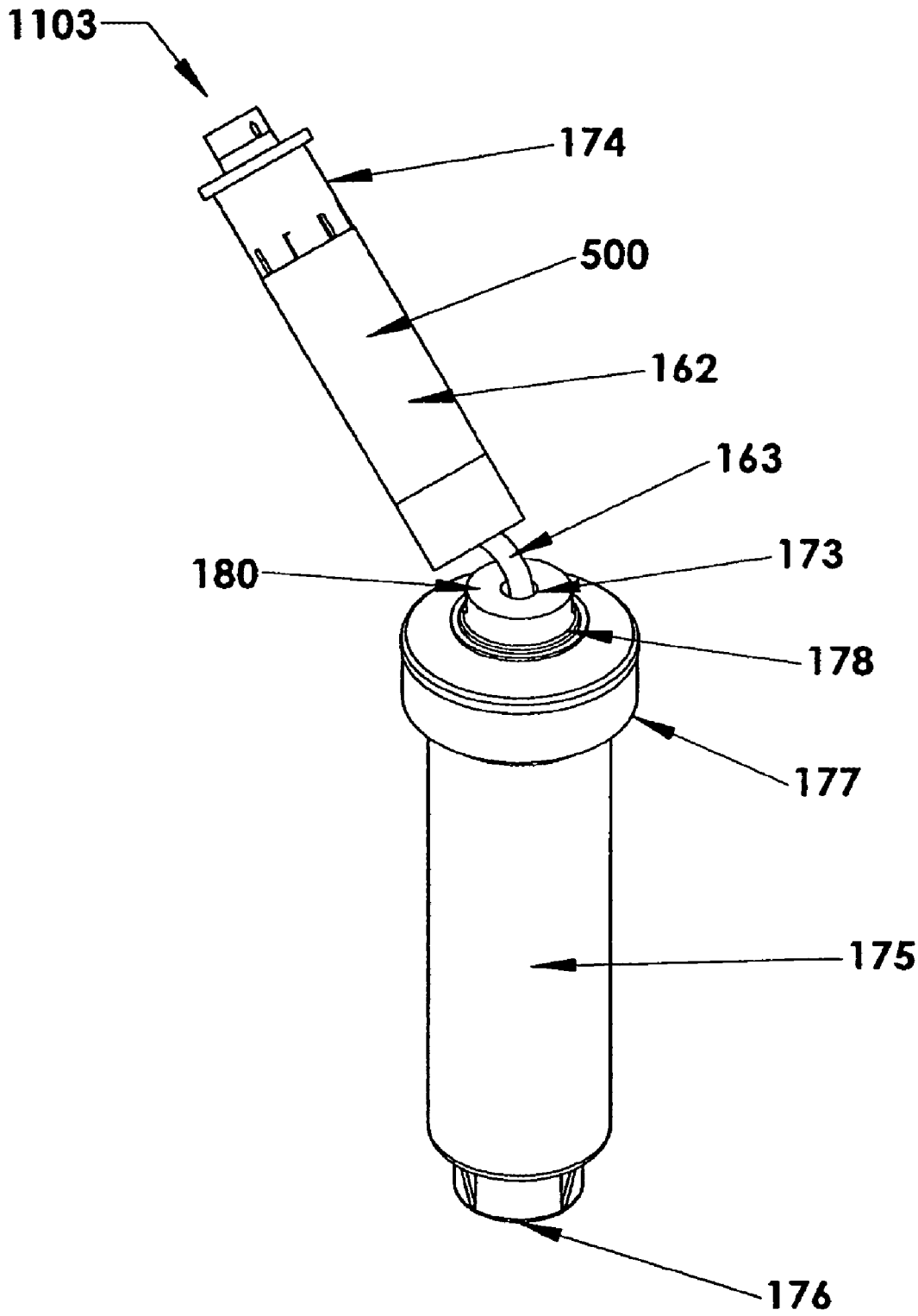

FIG. 5E illustrates non-pulsating irrigation pop-up 1103 at a position in which flexible stem 500 is bent by an external force, such as being stepped on or driven over. Elastic hollow member 163 slightly elongates and upper rigid segment 162 of flexible stem 500 bends as the external force is applied thereto. In one embodiment, flexible stem 500 and elastic hollow member 163 may be bent as much as about 90°, such that flexible stem 500 is lying on the ground. Therefore, upper rigid segment 162 may be bent at an angle of about 90° or less relative to lower rigid segment 161 upon the applied outside force. When the external force is removed, elastic hollow member 163 contracts and upper rigid segment 162 of flexible stem 500 return to its original position as depicted in FIG. 5C. Non-pulsating irrigation pop-up 1103 having flexible stem 500 is much more robust than an irrigation system having a rigid, non-flexible, or non-elastic stem due to the drastically reduction in the possibility of breaking flexible stem 500.

While the foregoing is directed to embodiments of the invention, other and further embodiments of the invention may be devised without departing from the basic scope thereof, and the scope thereof is determined by the claims that follow.

The invention claimed is:

1. An irrigation pop-up, comprising:

a rigid housing comprising a body having a water inlet and a cap having a pop-up outlet; and a flexible pop-up stem disposed at least partially within the rigid housing and movable within the rigid housing to extend at least partially through the pop-up outlet of the cap, the flexible pop-up stem comprising:

a lower rigid segment containing a first passageway extending therethrough from a lower rigid segment inlet to a lower rigid segment outlet;

an upper rigid segment containing a second passageway extending therethrough from an upper rigid segment inlet to an upper rigid segment outlet; and an elastic hollow member containing a channel and coupled to and in fluid communication with the lower rigid segment outlet and the upper rigid segment inlet, wherein the upper rigid segment is bendable relative to the lower rigid segment by way of the elastic hollow member.

2. The irrigation pop-up of claim 1, wherein the elastic hollow member is selected from the group consisting of tube, hose, pipe, conduit, duct, and derivatives thereof.

3. The irrigation pop-up of claim 2, wherein the elastic hollow member comprises rubber or derivatives thereof.

4. The irrigation pop-up of claim 2, wherein the elastic hollow member is cemented or glued to the lower rigid segment outlet and to the upper rigid segment inlet.

5. The irrigation pop-up of claim 1, wherein the flexible pop-up stem further comprises an elastic sleeve at least partially surrounding a rigid insert.

6. The irrigation pop-up of claim 5, wherein the rigid insert comprises a first inlet on a bottom surface, a first outlet on a side surface, a second inlet on the side surface, and a second outlet on a top surface.

7. The irrigation pop-up of claim 6, wherein the rigid insert further comprises a passageway between the first inlet and the first outlet, extending along and between the side surface and the elastic sleeve, and further extending between the second inlet and the second outlet.

8. The irrigation pop-up of claim 6, wherein the rigid insert further comprises at least one barb on the side surface and under the elastic sleeve.

9. The irrigation pop-up of claim 1, further comprising:

a water flow path extending from the water inlet, through the first passageway, through the channel, through the second passageway, and to the upper rigid segment outlet;

a spring coiled around the flexible pop-up stem and disposed within the rigid housing; and a flow control coupled to and in fluid communication with one of the first passageway within the lower rigid segment and the water inlet.

10. The irrigation pop-up of claim 1, wherein the body of the rigid housing comprises a water inlet port disposed between the water inlet and the flexible pop-up stem and in fluid communication with the first passageway.

11. The irrigation pop-up of claim 10, wherein the water inlet port has a diameter within a range from about 2 mm to about 3 mm.

12. The irrigation pop-up of claim 10, wherein the flexible pop-up stem comprises a plurality of slots at the lower rigid segment inlet.

13. The irrigation pop-up of claim 1, wherein the upper rigid segment outlet is coupled to and in fluid communication with a sprinkler head or a spray head.

14. The irrigation pop-up of claim 1, wherein the rigid body further comprises a wiper seal.

15. The irrigation pop-up of claim 1, wherein the upper rigid segment is bendable up to an angle of about 90° relative to the lower rigid segment.

16. The irrigation pop-up of 1, wherein the water inlet is configured to receive a relatively low continuous flow and a spray nozzle in fluid communication with the upper rigid segment outlet is configured to eject a high intermittent flow.

17. The irrigation pop-up of claim 1, wherein the flexible pop-up stem is configured to convert a relatively low controlled continuous flow entering the first passageway of the lower rigid segment to a high intermittent and pulsating flow ejected through the second passageway of the upper rigid segment.

18. The irrigation pop-up of claim 17, further comprising an elastic sleeve at least partially surrounding a rigid insert disposed within the upper rigid segment.

19. The irrigation pop-up of claim 18, wherein the rigid insert further comprises at least one barb on the side surface and under the elastic sleeve.

20. An irrigation pop-up, comprising:

a rigid housing comprising a body having a water inlet and a cap having a pop-up outlet;

a flexible pop-up stem disposed at least partially within the rigid housing and movable within the rigid housing to extend at least partially through the pop-up outlet of the cap, the flexible pop-up stem comprising:

a lower rigid segment containing a first passageway extending therethrough from a lower rigid segment inlet to a lower rigid segment outlet;

an upper rigid segment containing a second passageway extending therethrough from an upper rigid segment inlet to an upper rigid segment outlet; and an elastic hollow member containing a channel and coupled to and in fluid communication with the lower rigid segment outlet and the upper rigid segment inlet, wherein the upper rigid segment is bendable relative to the lower rigid segment by way of the elastic hollow member; and a water flow path extending from the water inlet, through the first passageway, through the channel, through the second passageway, and to the upper rigid segment outlet.

21. The irrigation pop-up of claim 20, wherein the elastic hollow member is selected from the group consisting of tube, hose, pipe, conduit, duct, and derivatives thereof.

22. The irrigation pop-up of claim 21, wherein the elastic hollow member comprises elastic plastic, flexible plastic, rubber, or derivatives thereof.

23. The irrigation pop-up of claim 20, wherein the inlet of the rigid housing is coupled to and in fluid communication with a water source of water by a flexible tube.

24. The irrigation pop-up of claim 23, wherein the flexible tube has an inner diameter to control and limit flow of water from the water source through the inlet of the rigid housing.

25. The irrigation pop-up of claim 17, further comprising a spring coiled around the flexible pop-up stem and disposed within the rigid housing.

26. The irrigation pop-up of claim 17, wherein the inlet of the rigid housing is coupled to and in fluid communication with a water source of water by a flexible tube.

27. The irrigation pop-up of claim 26, wherein the flexible tube has an inner diameter to control and limit flow of water from the water source through the inlet of the rigid housing.

* * * * *